US010086308B2

(12) United States Patent
Mowbray et al.

(10) Patent No.: US 10,086,308 B2
(45) Date of Patent: Oct. 2, 2018

(54) METHOD OF CONTACTLESS CHARGING OF AQUATIC TOY, TOY AND TANK THEREFOR

(71) Applicants: Mathew Peter Mowbray, Hamilton (NZ); Xiaoping Lu, Dongguan (CN)

(72) Inventors: Mathew Peter Mowbray, Hamilton (NZ); Xiaoping Lu, Dongguan (CN)

( * ) Notice: Subject to any disclaimer, the term of this patent is extended or adjusted under 35 U.S.C. 154(b) by 0 days.

(21) Appl. No.: 15/032,050

(22) PCT Filed: Oct. 24, 2014

(86) PCT No.: PCT/IB2014/065602
§ 371 (c)(1),
(2) Date: Apr. 25, 2016

(87) PCT Pub. No.: WO2015/059678
PCT Pub. Date: Apr. 30, 2015

(65) Prior Publication Data

US 2016/0256792 A1 Sep. 8, 2016

(30) Foreign Application Priority Data

Oct. 25, 2013 (NZ) ..... 617106

(51) Int. Cl.

| | |
|---|---|
| ***A63H 23/00*** | (2006.01) |
| ***A63H 23/10*** | (2006.01) |
| ***A63H 23/04*** | (2006.01) |
| ***A63H 23/14*** | (2006.01) |
| ***H02J 7/02*** | (2016.01) |

(52) U.S. Cl.
CPC ..... *A63H 23/10* (2013.01); *A63H 23/04* (2013.01); *A63H 23/14* (2013.01); *H02J 7/025* (2013.01)

(58) Field of Classification Search
CPC ..... A63H 17/26; A63H 18/12; A63H 23/00; A63H 23/04; A63H 23/10; A63H 23/14; A63H 33/26
USPC ..... 446/153, 158, 160, 161, 162, 444, 163, 446/164; 463/62
See application file for complete search history.

(56) References Cited

U.S. PATENT DOCUMENTS 1,595,801 A * 8/1926 McDonald ..... A63H 23/08 273/140
3,924,350 A * 12/1975 Hsu ..... A63H 3/26 273/457
3,970,309 A * 7/1976 Sato ..... A63H 18/023 446/197

(Continued)

FOREIGN PATENT DOCUMENTS

EP 1134011 A2 9/2001

OTHER PUBLICATIONS

PCT International Search Report for PCT International Patent Application No. PCT/IB2014/065602, dated Feb. 16, 2015.

*Primary Examiner* — Alexander Niconovich
(74) *Attorney, Agent, or Firm* — Holland & Hart LLP

(57) ABSTRACT

A combination aquatic toy and a reservoir wherein the reservoir comprises a container to contain a body of water and a contactless electrical power transfer transmitter, the toy is a submersible or is submersible and comprises a body carrying a battery and a battery powered propeller (fin or screw propeller or foil or impeller or other) to drive the toy through the body of water and contactless power transfer receiver to receive power, when in sufficient proximity to the transmitter, from the transmitter.

21 Claims, 6 Drawing Sheets

(56) References Cited

U.S. PATENT DOCUMENTS

| | | | | |
|---|---|---|---|---|
| 5,785,563 | A * | 7/1998 | Peaslee | A63B 43/00 114/315 |
| 6,762,586 | B2 * | 7/2004 | Choi | A63H 18/12 320/107 |
| 8,460,051 | B2 * | 6/2013 | Rudell | A63H 23/16 446/153 |
| 8,500,509 | B2 * | 8/2013 | Orozco | A63H 23/14 40/409 |
| 8,782,934 | B2 * | 7/2014 | Pearce | A63H 33/26 40/406 |
| 9,090,214 | B2 * | 7/2015 | Bernstein | B60R 11/00 |
| 9,300,230 | B2 * | 3/2016 | Belisle | H01F 7/0236 |
| 9,352,236 | B1 * | 5/2016 | Fernandez | A63G 31/007 |
| 9,488,364 | B2 * | 11/2016 | Chien | A63H 3/003 |
| 2003/0027483 | A1 * | 2/2003 | Rosenberg | A63H 23/10 446/129 |
| 2010/0130096 | A1 * | 5/2010 | Baarman | A63H 17/26 446/444 |
| 2013/0017754 | A1 * | 1/2013 | Lu | A63H 33/26 446/158 |

* cited by examiner

METHOD OF CONTACTLESS CHARGING OF AQUATIC TOY, TOY AND TANK THEREFOR

FIELD OF THE INVENTION

The present invention relates to a method of contactless charging of an aquatic toy, toy and tank therefor.

BACKGROUND

Water borne toys such as those that simulate fish and submarines and the like may utilize electronics and mechanics to propel the toy though the water. By way of example described in US20130017754 is a toy fish that has an oscillating tail fin to cause the toy to be propelled through the water. Complex mechanics may often require a substantial amount of power, and as like most remote control toys, often may have short battery life. The toy fish may need to be fished out or removed from the area it is swimming in to be charged externally. In large tanks, or complex inaccessible tank areas, this is not desirable.

It is an object of the present invention to provide an aquatic toy which overcomes or at least partially ameliorates some of the abovementioned disadvantages or which at least provides the public with a useful choice.

BRIEF DESCRIPTION OF THE INVENTION

In a first aspect the present invention may be said to an apparatus for providing a kinetic display the apparatus comprising:

a container defining a movement limiting environment in which a mobile apparatus is to move, and a mobile apparatus comprising an inductively chargeable battery and being capable of self locomotion in the environment under power derived from the battery;

wherein there is a defined zone in said environment to inductively interact to charge the battery of the mobile apparatus when said mobile apparatus is at least in a position selected from one of (a) sufficient proximity to the zone and (b) stationed at or in the zone;

and wherein the mobile apparatus is arranged to i. self station when below a first threshold charge status, and ii. self linger in sufficient proximity to the zone when below a second threshold charge status.

Preferably the second threshold charge status is higher than the first threshold charge status.

Preferably the container can contain a medium in which said mobile apparatus is capable of self locomotion.

Preferably the mobile apparatus includes an onboard controller to terminate power to cause said self locomotion when said first threshold charge status is reached.

Preferably the mobile apparatus includes a controller to recommence self locomotion once a the second status is reached to move said mobile apparatus way from the zone.

Preferably the medium is water and the mobile apparatus is submersible or semi submersible in the medium.

Preferably the mobile apparatus is negatively buoyant in water.

Preferably the mobile apparatus is positively buoyant in water.

Preferably the mobile apparatus when self propelling is adapted to move towards the surface of the body of water.

Preferably the mobile apparatus when self propelling is adapted to move away from the surface of the body of water.

Preferably said zone is defined by a charge transmitter.

Preferably the container comprises a base and at least one sidewall projecting upwardly from the base, and the zone defined is adjacent the juncture of the base and side wall.

Preferably there are two side walls and the zone is defined at the corner of the base and two side walls.

Preferably the zone is defined at the base adjacent the side wall(s).

Preferably the charge transmitter is a pad.

Preferably the pad is less than 100 square centimeters.

Preferably the pad is smaller than the wall of the container at where is it located.

Preferably the pad is of a size less than 20% of the area of the wall of the container at where it is associated.

Preferably container comprises a shallow trough defined in said environment to facilitate the retention of the mobile apparatus at or proximate said zone when charging.

In a further aspect the present invention may be said to be a submersible toy vehicle comprising a control circuit and an onboard inductively chargeable battery system, said battery system comprises at least a rechargeable battery, the toy vehicle being able to move a body of medium under its own propulsion, said control circuit monitors the charge status of the battery and controls propulsion of the toy vehicle whereby:

a) allows unrestricted movement of vehicle in the medium when the battery charge status is above a first charge status and below a full charge status, b) if below said first charge status, allows movement of the vehicle only sufficient to locate to and/or localise to an inductive charge receiving zone provided in said body of medium for the battery, c) if (b) has occurred, allows movement of the vehicle only sufficient to localise to the inductive charge receiving zone even when the charge status is above said first charge status, and d) if (c) has occurred, allows unrestricted movement of the vehicle when the battery charge status achieves a full charge status or a second charge status below full charge status but above the first charge status.

In a further aspect the present invention may be said to be, in combination, a toy vehicle as hereinbefore described and a tank to retain the body of medium and to define a movement limiting environment for the vehicle, wherein the tank provides in use an inductive charge receiving zone in which said toy vehicle can be charged.

In a further aspect the present invention may be said to be an apparatus with a control circuit and adapted to move on a surface of, or in a medium, under its own propulsion reliant on energy derived from an on board battery able to be inductively charged, the control circuit i. allowing unrestricted movement when the battery charge status is above a 'need to charge' threshold below full charge, and ii. allowing restricted movement, if any, only sufficient to localise in, or to locate and localise in, an inductive charging zone when below said 'need to charge' threshold charge status and maintain that restricted mode until a full charge status or a 'now free to roam unrestricted' charge status is reached being higher than the 'need to charge' status.

In a further aspect the present invention may be said to be an apparatus for providing a kinetic display the apparatus comprising or including environment of movement delimiting apparatus to define an environment, or to define an environment to contain a medium, in which a mobile apparatus is to move, and a said mobile apparatus with a propulsion system, a control circuit and an inductively chargeable battery and being capable of self locomotion in the environment, or a said medium in the environment, reliant on energy derived from its battery and its propulsion system when the battery is at at least a sufficient charge status;

wherein there is a defined zone of, within and/or without the delimiting apparatus to inductively interact to charge the battery of the mobile apparatus when it is in sufficient proximity to the zone and/or is stationed at or on the zone;

and wherein the control circuit is capable of monitoring the charge status of the battery and controlling propulsion whereby:

a) if fully charged, allows unrestricted movement when the battery charge status remains above a first charge status below full charge status, b) if below said first charge status, allows movement only sufficient to locate to and/or localise to an inductive charge receiving zone for the battery, c) if (b) has occurred, allows movement only sufficient to localise to the inductive charge receiving zone even when the charge status is above said first charge status, and d) if (c) has occurred, allows unrestricted movement when the battery charge status achieves a full charge status or a second charge status below full charge status but above the first charge status.

In a further aspect the present invention may be said to be a battery powered submersible toy vehicle with a control circuit able to move under its own propulsion in a tank confining a body of water within which is provided an inductive charge field, said propulsion being reliant on energy derived from an onboard inductively chargeable battery system, the control circuit monitoring the charge status of the battery and controlling propulsion whereby:

a) allows unrestricted movement of said vehicle in the body of water when the battery charge status remains above a first charge status and below full charge status, b) if below said first charge status and when charge field inducted charging of said battery is detected, stops vehicle propulsion, and c) if (b) has occurred, allows unrestricted movement of the vehicle when the battery charge status achieves a full charge status or a second charge status below full charge status but above the first charge status.

In a further aspect the present invention may be said to be, in combination, a device able to self propel under its own battery powered drive when the battery has a charge, the battery circuit being able to receive an inductive input to charge the battery, and an inductive charging device; wherein the device to be self propelled has a control functionality able to affect the drive and able to favour proximity to the charging device to charge the battery; and wherein the control functionality is responsive to the battery charge status such that it;

a) if fully charged, allows unrestricted movement when the battery charge status remains above a first charge status below full charge status, b) if below said first charge status, allows movement only sufficient to locate to and/or localise to an inductive charge receiving zone for the battery, c) if (b) has occurred, allows movement only sufficient to localise to the inductive charge receiving zone even when the charge status is above said first charge status, and d) if (c) has occurred, allows unrestricted movement when the battery charge status achieves a full charge status or a second charge status below full charge status but above the first charge status.

In a further aspect the present invention may be said to be a combination aquatic toy and a tank wherein the tank can retain a body of water and comprises a contactless or wireless electrical power transfer transmitter, the toy is submersible and comprises a body carrying a rechargeable battery and a battery powered propeller to self propel the toy through the body of water and a contactless power transfer receiver to receive electrical power to charge the battery, when in sufficient proximity to the transmitter, from the transmitter.

Preferably, the powered propeller is one or more selected from a fin or screw propeller or foil or impeller or other.

Preferably, the toy is arranged and configured so that when the propeller is powered, the toy moves through the body of water but when not powered, the toy sinks in the body of water.

Preferably, the transmitter is at the bottom of the body of water.

Preferably the transmitter is at the base of the container.

Preferably the transmitter is at a wall of the container below the body of water.

Preferably the transmitter is built into a wall of the container.

Preferably the transmitter is located at the side of the body of water.

Preferably the transmitter is in the body of water between the surface and bottom.

Preferably the toy can be controlled to stop self propulsion and consequently sinks to the bottom of the body of water, at predetermined intervals for the purposes of charging the battery.

Preferably the toy is arranged and configured so that when the propeller is powered, the toy moves through the body of water but when not powered, it floats to the surface of the body of water.

Preferably the toy floats to the surface of the body of water at predetermined intervals for the purposes of charging the battery.

Preferably the propeller is driven by an electric powered driver.

Preferably the toy includes a timer circuit to turn on and off power supply to the driver.

Preferably the toy is of negative buoyancy in water.

Preferably the toy is of positive buoyancy in water.

Preferably, the propeller is driven by an electrically powered driver and the toy sinks in the body of water when the battery power supplied to the driver falls below a certain limit or is terminated.

Preferably the toy does not sink to the bottom when the power to the driver is above a certain limit and the toy is being driven.

Preferably the toy floats to the surface when the power to the driver falls below a certain limit or is terminated.

Preferably the toy does not float to the surface when the power to the driver is above a certain limit and the toy is being driven.

Preferably the toy is a biomimitic fish or mermaid.

Preferably the toy is a submarine.

Preferably recharging of the onboard battery may be continuous or periodic.

Preferably recharging may occur without the toy needing to stop moving or needing to move to a dedicated charging zone in the tank.

Alternatively the toy may recharge from time to time.

Preferably, the toy comprises a controller to stop the propeller to allow the toy to settle and allow a recharge of the battery in a situation selected from one of:

when the battery runs out of electrical power, and when the battery drops below a certain voltage level, and after a certain time interval.

Preferably the toy is negatively buoyed yet is configured and adapted to travel up in the body of water when propelled.

Preferably the toy is positively buoyed yet is configures and adapted to travel down in the body of water when propelled.

The toy when it stops being propelled may sinks to the bottom of the tank to be in sufficient proximity to be charged via a bottom proximate located transmitter.

The toy when it stop being propelled may floats to the surface to be in sufficient proximity to be charged via a surface of the body of water proximate located transmitter.

Preferably the toy has a timing circuit to terminate propulsion after batter voltage drops below a level, for a certain duration and during recharging.

Preferably the toy includes a controller to terminate propulsion until a certain battery voltage is exceeded before starting propulsion.

Preferably the toy controller may turn off propulsion, even if the battery has not lost a lot of charge, to allow the toy to sink to the bottom and be recharged.

In a further aspect the present invention may be said to be a submersible self propelled rechargeable battery powered toy comprising a body carrying a battery and a battery powered propeller to propel the toy through a body of water and a contactless power transfer receiver to receive power and recharge said battery, when in sufficient proximity to a compatible power transmitter, from said transmitter.

Preferably, the powered propeller is one selected from a fin or screw propeller or foil or impeller or other.

Preferably, the toy is arranged and configured so that when the propeller is powered, the toy moves through the body of water but when not powered, the toy sinks in the body of water.

Preferably the toy is controlled to sink in the body of water at predetermined intervals.

Preferably the toy is arranged and configured so that when the propeller is powered, the toy moves through the body of water but when not powered, it floats to the surface of the body of water.

Preferably the toy floats to the surface of the body of water at predetermined times.

Preferably, the toy comprises a controller to terminate power delivered to the propeller when recharging of said battery is detected, when said battery voltage is below a predetermined level that is below its peak charge.

Preferably the toy comprises a controller to reduce the power delivered to the propeller when the battery voltage drops below a certain limit, and to terminate power delivered to the propeller when recharging of said battery is detected.

Preferably the toy is negatively buoyant in water and sinks in water when the power to the propeller falls below a certain limit or is terminated.

Alternatively the toy is positively buoyant in water and float to the surface when the power to the propeller falls below a certain limit or is terminated.

Preferably the toy comprises a controller that terminates power to the propeller when the battery voltage drops below a predetermined low voltage level or after a certain interval and recommences provision of power to the propeller when the battery voltage exceeds a recharge voltage.

Preferably the toy comprises an external controller which receives input from an onboard controller of the toy, said external controller is arranged to activate a charge seeking model of the toy and to control the movement of the toy by controlling the power supplied to the propeller.

Preferably the toy is negatively buoyed and when it stops being propelled it sinks to the bottom to be in sufficient proximity to be charged via the charge transmitter.

Alternatively the toy is positively buoyed and when it stops being driven it floats to the surface to be in sufficient proximity to be charged via the transmitter.

Preferably the toy has a timing circuit to remain idle (e.g. after losing charge) for a certain duration and during recharging.

Alternatively, the toy remains idle until a certain charge limit has been reached before starting to swim again.

In a further aspect the present invention may be said to be a tank defining a containment region to retain a body of water and a contactless electrical power transfer transmitter.

Preferably the transmitter is located at a portion of the base of the tank.

Preferably the transmitter is located in the corner of a tank at the base.

Preferably the tank can receive a self propelling battery powered water submersible toy that comprises a body carrying a battery and a battery powered propeller to propel the toy through the body of water and contactless power transfer receiver to receive power, when in sufficient proximity to the transmitter, from the transmitter.

Preferably the tank comprises a base wall from which there upwardly extends at least two side walls, a contactless power transfer transmitter located at a region of the tank to establish a charge field in the tank at the juncture of the base and said side walls.

Preferably the base and side walls cooperate to retain water in said tank.

Preferably the transmitter operates at a voltage less than 20 v.

Preferably the tank comprises a trough region at the base wall located in said charge field, provided to help keep a chargint toy captive in said field within the trough.

Preferably the tank further comprises a controller to send and receive control signals to a said toy located in said tank.

Preferably the controller can instruct the toy to start and stop and slow propulsion.

In a further aspect the present invention may be said to be a method of recharging a self-propelled toy contained in a movement limiting environment defined by a tank, said toy comprises an onboard wirelessly rechargeable battery, said tank comprises a wireless power transfer transmitter arranged to recharge the onboard battery of the toy, the method comprising the steps of:

detecting proximity of the toy to the power transfer transmitter and generating a representative proximity signal, controlling movement of the toy based on the proximity signal to encourage the toy to settle in a desired recharging zone generated by the transmitter and allowing the battery to be wirelessly charged in the recharging zone.

Preferably before detecting the proximity of the toy to the transmitter, detecting battery voltage and activating a charge seeking mode when the voltage detected falls below a predetermined threshold voltage.

Preferably the method further comprising starting propulsion of the toy again after a predetermined time period or after the battery voltage increases to a predetermined voltage level.

Also herein described is a water submersible self propelling toy that comprises a body carrying a rechargeable battery and a battery powered propeller to propel the toy through the body of water and contactless power transfer receiver to receive power when in sufficient proximity to a charge field and a controller to control the toy's propulsion.

Preferably the controller can stop and start the toy's propulsion.

Preferably the toy comprises a sensor to sense the voltage of the battery the controller ustilsing the sensed voltage for the purposes of starting and stopping the toy's propulsion.

Preferably the controller will start the propeller when the toy is stationany and the battery is being charged and the batter voltage exceeds a predifined threshold.

Preferably the controler will stop the propeller when the toy is moving in the tank and the battery voltage drops below a predefined threshold and the sensor detects a battery charge voltage from the charge field.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification means "consisting at least in part of". When interpreting statements in this specification [and claims] which include that term, the features, Prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.)

BRIEF DESCRIPTION OF THE DRAWINGS

The invention will be further described with reference to the accompanying drawings and embodiment.

DETAILED DESCRIPTION OF THE INVENTION

With reference to the drawings, in which similar features are generally indicated by similar numerals, an aquatic toy 300 and container, reservoir or tank 200 (herein after tank") able to retain a body of water are generally indicated by the numeral 1000.

The aquatic toy 300 may be a biomimetic fish or other aquatic vehicle such as a boat or submarine that is contactlessly chargeable whilst remaining in said tank. It is able to do so in a dockless manner.

The toy is preferably submersible or semi submersible. It may remain floating at the surface of the body of water or may be able to submerge and/or remain submerged. In some embodiments the toy 300 may be designed to "walk" or drive over a surface of the tank, such as tank boundary surface or other surface of the tank contained in the tank, whether below or above the body of water.

Figure 3:
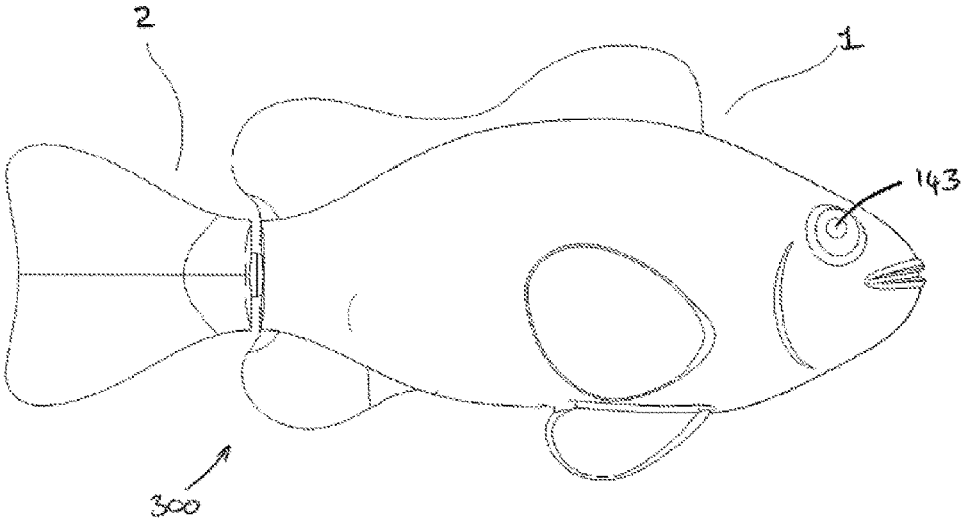
FIG. 3 is a schematic diagram of the external structure of an embodiment of the aquatic toy of the invention.
Figure 4:
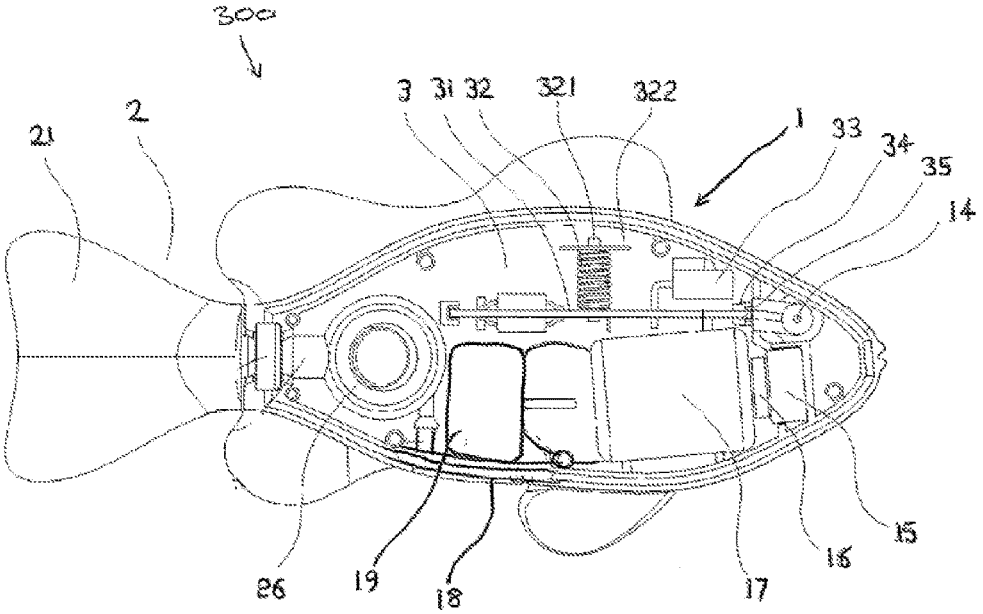
FIG. 4 is a schematic diagram of the internal structure of FIG. 3 with one side of its shell body cutaway.
Figure 7:
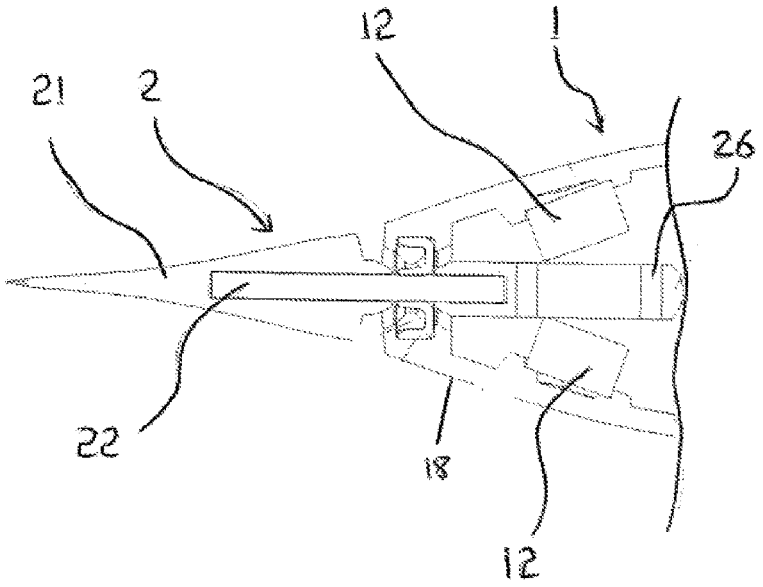
FIG. 7 is plan schematic of an embodiment of the toys tail section.

Taking a biomimetic fish as an example and as shown in FIGS. 3 and 4 the toy 300 may comprise a body 1 and dependent propeller 2 that is in the form of a fish tail assembly. It is envisaged that the propeller may be a fin, screw propeller, foil, impeller or other. A housing or cover 18 is made of a plastics material. The fish tail assembly 2 comprises a fish tail 21 that can make a swishing oscillatory like motion relative to the body and thereby propel the fish through the water. The body is preferably made from a rigid plastic and the tail 21 from a more flexible plastic. However, alternative appropriate materials may be used. A coil and magnet arrangement is preferably disposed in the body assembly 1 as shown in FIG. 7. The coil can be energized to cause the tail to oscillate. In one form the coil and magnet arrangement may be presented in a manner where two magnets 12 and one coil 26 are present in the body assembly 1. The outer end of the tail shaft 22 carries the fish tail 21.

The toy 300 includes a rechargeable power source or supply such as battery or capacitance device or other power storage device, and associated power supply circuitry and charging circuitry. The battery can be recharged by way of contactless or wireless charging of the toy whilst it remains in the tank, and without having to specifically manoeuvre the toy, by way of a wireless charge transmitter that will herein after be described.

The battery powered propeller is provided to drive the toy 300 to move in the body of water. In this embodiment, the propeller is driven by an electric powered driver. In one form, the toy 300 is arranged and configured so that when the propeller is powered, the toy 300 moves through the body of water but when not powered, it either sinks to the bottom of the body of water or starts to float at the surface. I.e., the toy 300 is of negative or positive buoyancy. In other embodiments the toy may be of neutral buoyancy, and the toy drives itself down or up.

In one form, the toy 300 includes a timer circuit and/or programmable or programmed controller implemented by way of a programmable device or devices, such as a microcontroller, microprocessor or other integrated circuit (IC) or similar, to control and/or turn on and off power supply to the driver.

Due to the toy being able to be contactlessly or wirelessly charged, the housing of the toy can be made watertight and requires no seal or charging port.

Additionally, in the preferred form of the aquatic toy, an activation circuit is provided for the toy. The activation circuit is associated with the drive control circuit and is provided to activate the energization of the coil(s). The activation circuit may be selected from one of (a) a vibration switch and (b) moisture sensor or (c) terminals of a circuit or switching circuit that complete an electrical circuit via water in which said aquatic toy may be placed. This can help conserve battery power when the toy is removed from the water.

Where the toy is a fish, a deflecting force can be produced when the fish goes forward if the fish tail is at a certain angle to the fish body. This will cause the fish to turn. Different durations of swing of the fish tail on opposite sides of the fish centreline will cause a non-symmetric deflecting force and the fish can turn accordingly. Thus the fish's moving direction can be changed by altering the forward-direction and backward-direction current pulses in the coil 26, which is supplied by a drive control circuit 3. The altering of the current pulses may be by way of duration, amplitude or by applying an offset sine wave current pulse to the coil or coils.

In the preferred form the drive control circuit or controller 3 comprises a PCB 31, a vibration switch 32 and LED indicator lights 34 and 35. The indicator lights 34, 35 are capable of showing a status of activation of the fish or charging of the fish respectively. The drive control circuit is powered by the battery 17.

Where a vibration switch 32 is used, it may consists of a central post 321 and a vibration spring 322. When vibration of the fish body is transmitted to the spring, the spring starts to swing and will contact with the central post when the swing exceeds a certain amplitude. Accordingly an electric signal is generated to activate the drive control circuit.

In some forms of the invention, the drive control circuit or controller 3 may include an infrared receiving tube 33. The infrared receiving tube 33 is capable of receiving a transmitted remote control signal from a transmitter outside the fish. In response to the transmitted signal, the control circuit will execute a corresponding operation according to the received signal.

Referring to FIG. 4, the operation of the indicator lights 34, 35 will be described. When the drive circuit is in operation, the LED indicator light 34 is lit up. Alternatively, when the fish is charging, a different LED indicator light 35 is lit up. Light from each of these hits the incident surface and then the reflector 14. Light can be reflected by two reflecting surfaces to be emitted to both sides of the fish out through the fish eyes 143.

In the envisaged form the toy is negatively buoyed and has a thrust angle aiming slightly up when swimming to help keep the toy swimming above the bottom. This may also be achieved by having a centre of mass located just aft of the centre of buoyancy for the fish example and assuming the fin has net thrust angle acting axially through the fish. It could also be achieved by an off axis thrust angle.

Alternatively, the fish body is internally provided with an additional coil 15, and at least one additional magnet 16 (however, more than one magnet may be used), that is attached to the battery 17 that powers the drive control circuit 3. A magnetic field generated by the coil when the coil 15 is supplied with an electric current (from the drive control circuit), interacts with the magnet 16 to create an attraction force or a pushing force to drive the battery 17 to move. When the battery moves forward the centre of gravity of the fish shifts forward simultaneously, such that a downward component force is produced to drive the fish downwards while the fish tail 2 is operating. When the magnet 16 drives the battery 17 to move backward, the centre of gravity of the fish shifts backward simultaneously, effectively lifting the fish head, such that there will be an upward component force to drive the fish upwards while the fish tail 2 is operating.

An alternative method of changing the centre of gravity of the fish is to fix a magnet 16 and allow a coil to be movable, such that the coil drives the battery or any other counterweight member to move.

Alternatively the fish's centre of gravity can be adjusted in a right-left direction using either of the above methods but when the above mechanisms are arranged transversely. Again, alternatively, the fish's centre of gravity can be adjusted in a forward-backward direction when either of the above mechanisms are arranged vertically.

Other aspects of the biomimetic fish as described in US20130017754 that are hereby incorporated by way of reference.

The toy 300 can be used in a tank 200 that can contain a body of water e.g. a fish tank. The tank 200 preferably comprises at least one transparent region of a sidewall(s).

The toy 300 is charged or recharged by a wireless or contactless power transfer system comprising one or more contactless power transfer transmitters in, on or in the vicinity of the tank and a corresponding contactless power transfer receiver in the toy. In this embodiment, the tank 200 incorporates a wireless or contactless electrical power transfer transmitter 100 and which defines a recharging zone of the tank within which the toy 300 may be recharged. The recharging zone is preferably in a location to be below the waterline although it may be above.

The toy 300 is configured to be re-charged by the power transfer transmitter 100. The power transfer transmitter 100 may be of a variety of different structures or assemblies. In some embodiments the transmitter may take the form of a plate, grid, mat. The transmitter 100 may be located in a position so that its charge field is able to be entered by the toy whilst in the tank, for the purposes of recharging. The transmitter may be located on the outside of the tank wall or embedded inside the tank wall. It may be submersible yet watertight to prevent current contact with water. Alternatively, current contact with water may happen. In such an embodiment the transmitter operating voltage can be sufficiently low so that it cannot cause significantly discernable electric shock/discharge to a person that may put their hand into the water. The transmitter may be powered via a transformer that is plugged into a mains power supply 10. Power derived from solar or other external source are also contemplated.

In a preferred embodiment the transmitter 100 is in the form of a mat or planar box that is secured to the tank, preferably below the waterline. In other embodiments the transmitter 100 is integral with the bottom face of the tank. In further embodiments, the transmitter 100 is integral or attached with or to the sidewalls of the tank 200. Alternatively, the transmitter 100 is at a wall of the container below.

Figure 5:
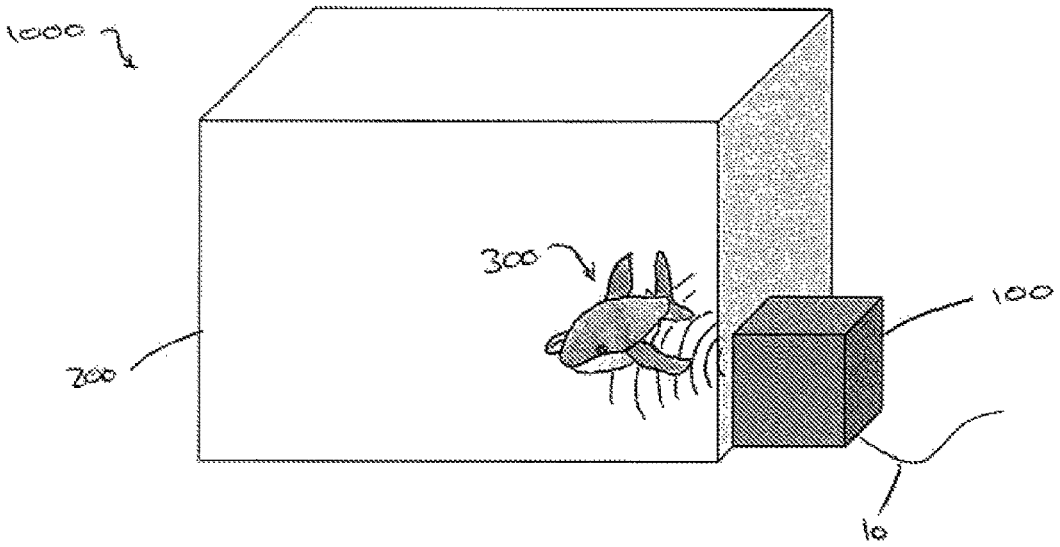
FIG. 5 shows an illustration of a toy being charged by a standalone charge transmitter.

Given that the toy will generally move around the tank in a random manner, it tends to spend more time in corners of a tank, where the tank is for example box shaped. For this reason the preferred location of the transmitter is at a corner. This corner may be the junction of two side walls of the tank. Preferably it is the junction of two side walls and the base of a tank, where the tank is for example box shaped as seen in FIG. 5.

The transmitter 100 may instead be in the body of water between tank boundary surfaces.

The transmitter 100 may comprise of a coil.

In some forms the toy may be amphibious and the transmitter 100 may be located above the waterline as part of or adjacent a surface onto which the toy 300 is able to move and at where it can enter the recharging zone to be recharged.

A combination of separate charging transmitters may be placed about the reservoir. More than one transmitter may be used to set up a plurality of charging zones. This is useful in large reservoirs where the toy 300 needs to be able to get to the closest charging transmitter 100 before the battery 17 goes flat.

Figure 8:
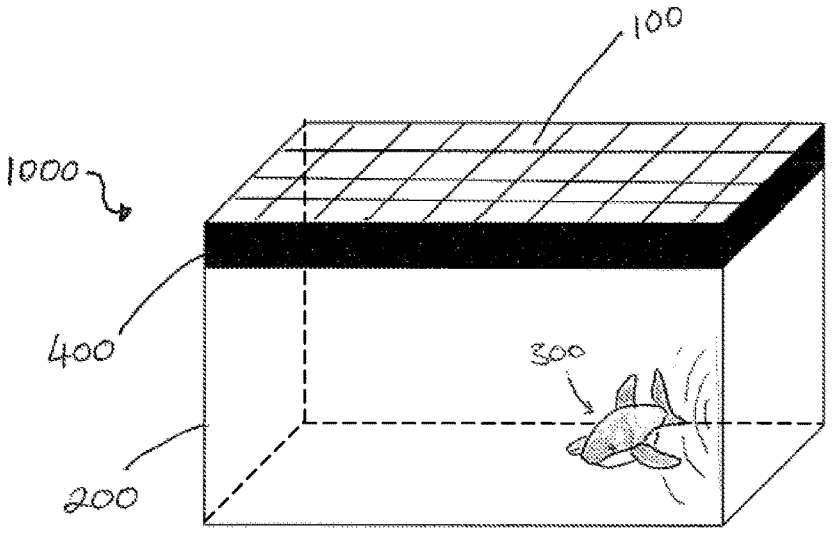
FIG. 8 shows an illustration of a toy being charged by a lid transmitter.

In further alternatives, the transmitter 100 is integral or attached to a lid 400 of the reservoir. As shown in FIG. 8, the lid 400 of the reservoir may optionally comprise an opaque skirt or portion that extends about the periphery of at least an upper portion of the reservoir. The height of the opaque skirt being configured relative to the size of the toy such that the toy may be at least partially concealed from view when floating on the surface of the water.

Figure 1:
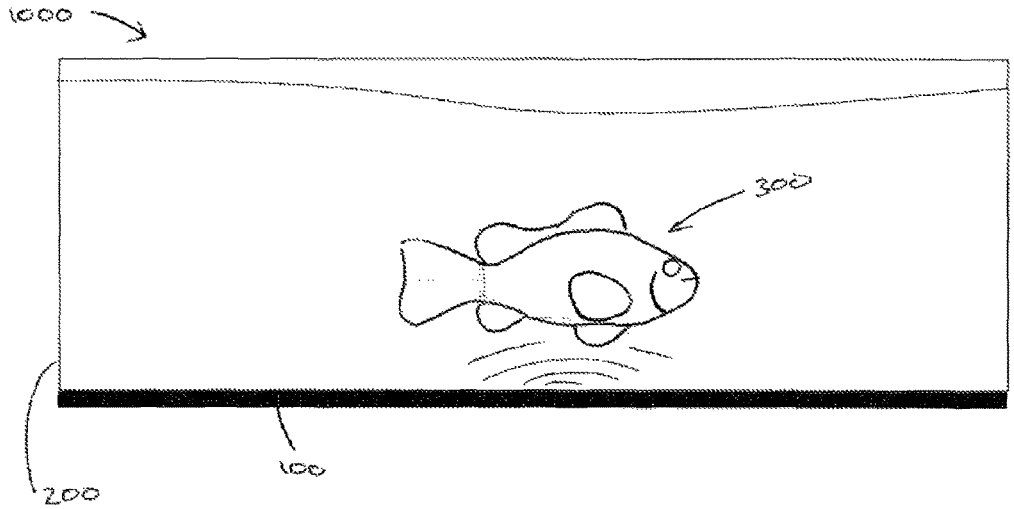
FIG. 1 is a side illustration of a toy, tank and charging transmitter.
Figure 2:
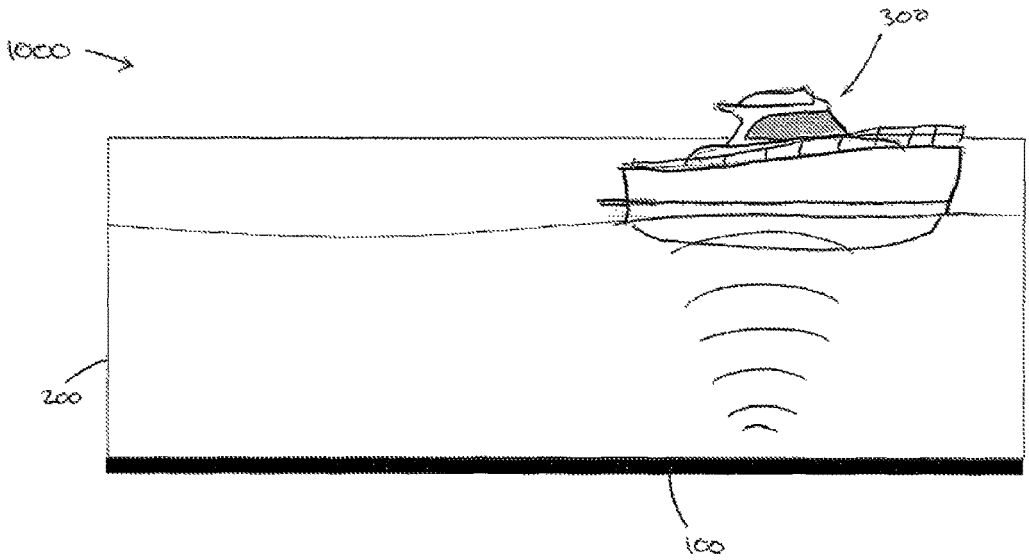
FIG. 2 is an alternative toy to FIG. 1.
Figure 6:
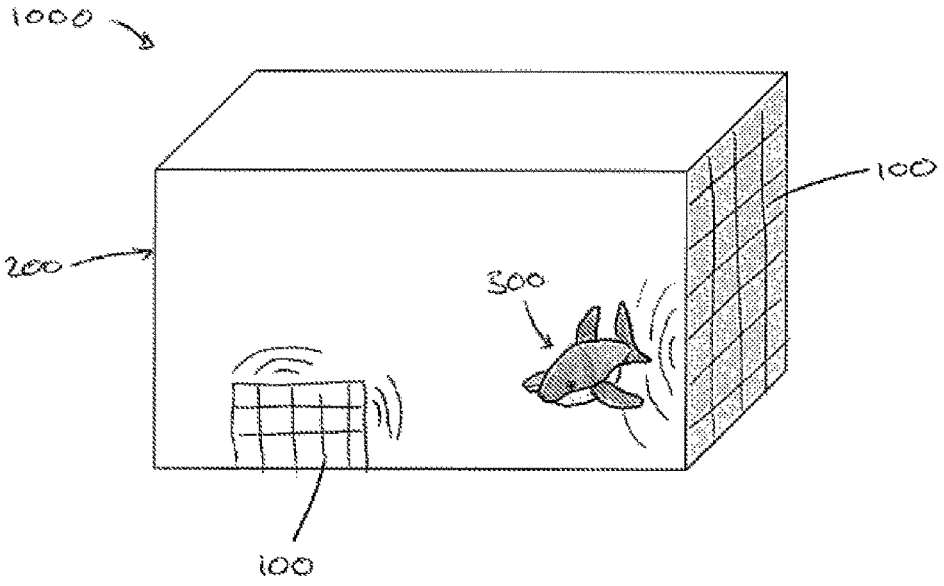
FIG. 6 shows an illustration of a toy being charged by a sidewall charge transmitter or an affixed retrofit transmitter.

The reservoir may be provided integral with the transmitter 100 when the toy 300 is purchased as shown in FIGS. 1 and 2. Or existing reservoirs may be retrofitted with transmitters. Such retrofittable transmitters 100 may be in the form of stick on pads that adhere to the side or bottom of reservoirs as shown in FIG. 6 or the lid of reservoirs. Or the retrofittable transmitters may be in the form of a box that is placed next to the reservoir as shown in FIG. 5.

The transmitter may use one or more of a multitude of wireless or contactless power transfer options, whether loose-coupled or close-coupled, including but not limited to direct induction, resonant magnetic induction or electromagnetic induction in the form of microwaves or lasers in order to transfer power to the toy 300 and thereby recharge its battery 17. The toy 300 includes compatible power receiving capabilities or circuitry, such as a contactless power transfer receiver as described below.

The toy's onboard battery drives an electric driver(s), which in turn propels the toy 300. The toy 300 also comprises a contactless power transfer receiver 19 to receive power, when in sufficient proximity to the transmitter 100, from the transmitter 100. In one form, charging of the toy's onboard battery 17 may be continuous or periodic and without the toy 300 ever stopping or needing to move to a particular location in the tank. The toy 300 may pass through a charging zone set up by a transmitter 100 reasonably frequent enough in order to be topped up in charge and remain sufficiently charged. Alternatively the toy 300 may recharge intermittently. This may occur when the toy:

1. runs out of electrical power and thereby stops being propelled, or
2. drops below a certain power level at which point it may stop propelling itself, or
3. after a certain time (e.g. every night time) at which point it may stop propelling itself.

A controller, implemented by a programmable device or devices such as a microprocessor, microcontroller or other integrated circuit, as part of the charging circuit of the toy, can be used for the purposes of 2 and 3. A stopping of the propeller may happen with or without the toy 300 moving or having specifically moved to a charging zone. As described above, the entire bottom of the reservoir may be contiguous. The transmitter 100 and the toy 300 may naturally move there once it stops propelling itself, merely by sinking to the bottom. The toy 300, when negatively buoyant and when it stops self propelling, can sink to the bottom of the tank and is then in sufficient proximity to the transmitter 100 to be usefully charged by the transmitter 100. The toy 300 may instead be positively buoyed and move to the top of the body of water and into the charge zone when such is in the vicinity of the top.

The toy 300 may have a timer so that the toy will remain idle (e.g. after losing charge or turning the propeller off) for a certain duration so as to get adequately recharged before the timer allows activation of the propeller again so that the toy will start moving about the tank. Alternatively the toy 300 may remain idle during charging and until a certain charge limit is reached before starting to be propelled again. A charge sensor may be used for these purposes. The charge sensor is preferably part of the charge circuit of the toy. The toy 300 may be programmed or controlled to turn off or slow down, even if it has not lost power or reached a certain threshold on the way to being completely discharged and may then sink to the bottom and be recharged.

The transmitter 100 may comprise a sensor that feedbacks with the toy 300 to allow the toy 300 to locate the transmitter 100 to charge itself. Alternatively no sensor is included as part of the transmitter 100 or the tank and sensing of the transmitter occurs by the toy 300 by virtue of it moving in the vicinity of the transmitter 100 and thereby sensing its charge field.

Preferably the toy 300 does not sink to the bottom or seek charge when the power to the driver is above a certain limit and/or the toy 300 is being driven. The toy in this state continues to roam the tank.

In an alternative embodiment recharging may occur without the toy 300 stopping or needing to move to a dedicated charging zone in the container. This allows the toy 300 to continue roaming/swimming whilst charging. This is more aesthetically pleasing than having a stationary toy in the reservoir 200. The toy 300 may be programmed to perform certain manoeuvres whilst recharging. Manoeuvres may include moving in circles, or moving about the tank bottom or recharging zone.

In an alternative configuration, the toy 300 may be positive buoyant, and may float to a charging zone at the surface of the body of water, for example adjacent a transmitter 100 integrated with or attached to a lid of the reservoir. In such configurations, the same or similar charging routines as above may apply, but with the toy floating to the surface, rather than sinking to the bottom.

The net thrust angle of the propeller and/or the toy's hydrodynamic lift when propelled through the water may be such at to cause the toy to move up or down when propelled.

If the toy is negatively buoyed and will hence sink when not or insufficiently propelled, the toy when propelled will move up in the body of water. If the toy is positively buoyed and will hence tend to float when not or insufficiently propelled, the toy when propelled will move down in the body of water. The charging zone is hence located in the tank at or near the or a bottom of the tank for the purposes of charging negatively buoyed toys and at or near the top of the body of water of water.

Figure 9:
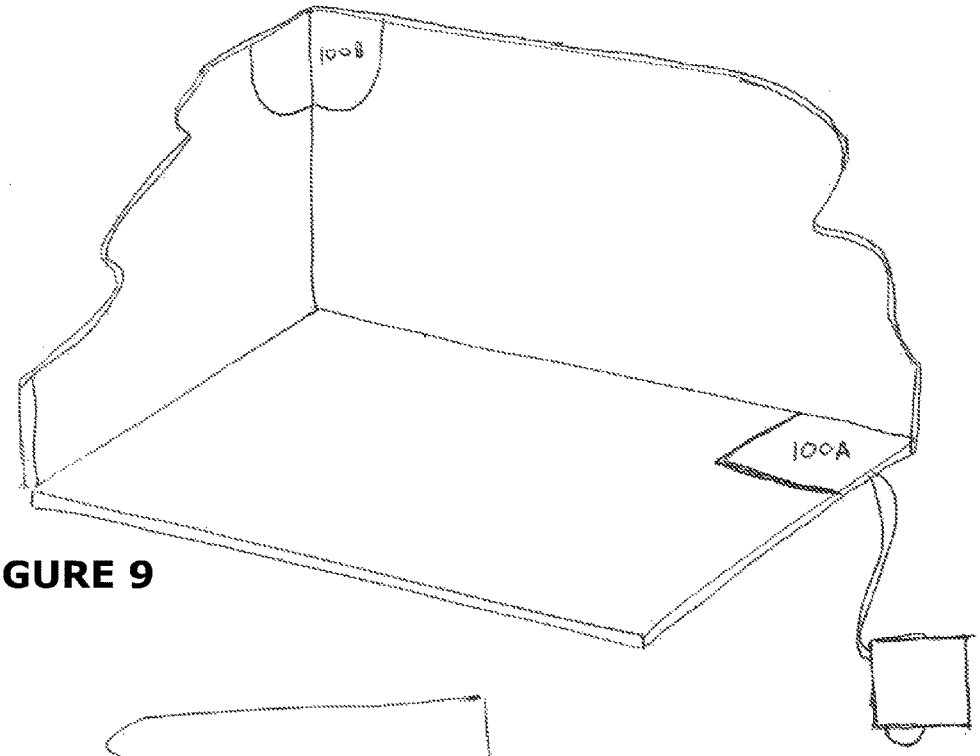
FIG. 9 is a partial cutaway sectional view of a tank and showing two examples of a charge transmitter, one at the base of the tank and one at or near the top, to be adjacent the surface of the water.
Figure 10:
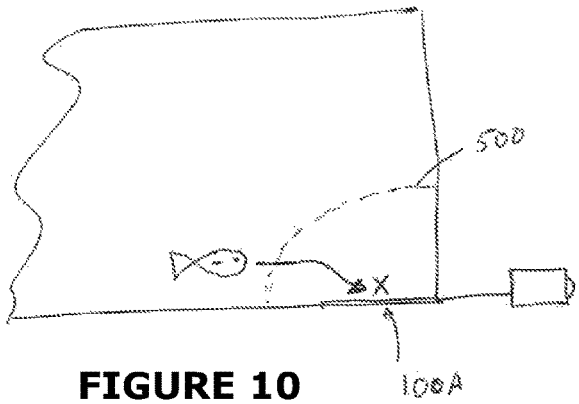
FIG. 10 shows a side view of the tank and a toy approaching a charge transmitter.

In a preferred form the charge transmitter 100 is of a size that is sufficient for a toy 300, when in close proximity to the transmitter 100, to be charged thereby, yet is of a non ubiquitous size. For example in FIGS. 9 and 10, part of a tank is shown where the charge transmitter 100A is less than the size of the base of the tank. This requires the toy 300 to be controlled when in need of recharging in a manner to help it settle for recharging in a location in the tank that sufficiently in the charge zone or field 500. The charge field 500 radiates from the charge transmitter 100 and weakens with distance from the transmitter 100. The toy's onboard sensing of the toy's proximity to the charge field 500 is used to control the toy in a manner to settle in the charge field sufficiently close or on the charge transmitter.

In an embodiment, the toy 300 may be provided with a proximity sensor or proximity sensor circuitry for detecting or sensing the toy's proximity relative to the charge zones or fields generated by the or each contactless power transfer transmitters 100. In this embodiment, the proximity sensor or proximity sensor circuitry may generate a proximity signal that is indicative of the toy's location or proximity relative to a charge zone or to the transmitter 100. The proximity signal, either alone or in combination with one or other control or sensor signals such as a battery level signal, is used by the toy's control circuitry to decide when to settle the toy near or on the power transfer transmitter for recharging. As will be further described below, various proximity sensing configurations or systems may be used to generate the proximity signal. In one form, the proximity signal may be generated based on a sensed level of voltage or current or power generated by the charging circuitry in response to being within range of the charging zone. In another form, the proximity signal may be generated by a sensor onboard the toy that can detect the level of magnetic or electric field generated by the power transfer transmitter. In each of these forms, the magnitude of the proximity signal may be proportionate to the level of the sensed voltage, current, power, and/or electric or magnetic field sensed. In yet another form, the proximity signal may be generated in response to a proximity sensor onboard the toy that is configured to receive or sense a transmitted signal from the power transfer transmitter 100 from which the toy's proximity to the transmitter can be deduced. For example, in one configuration, the power transfer transmitter 100 may comprise an associated infrared (IR) transmitter or transmitters that are configured to transmit or radiate an IR signal, which is pulsed, continuous, or otherwise, and which is detectable or received by an IR sensor onboard the toy when it is in the charge zone of the power transfer transmitter. Examples of these various alternative configurations are described further below.

Figure 11:
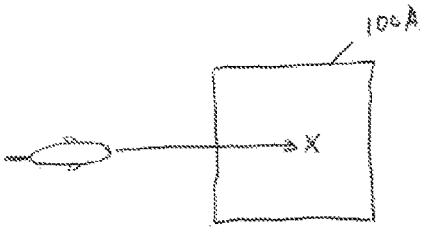
FIG. 11 shows a plan view of a charge transmitter and toy approaching in a manner to rest above the transmitter.
Figure 12:
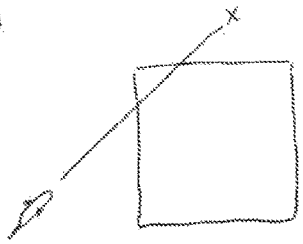
FIG. 12 shows a plan view of the charge transmitter and toy approaching in manner that will miss the transmitter.
Figure 13:
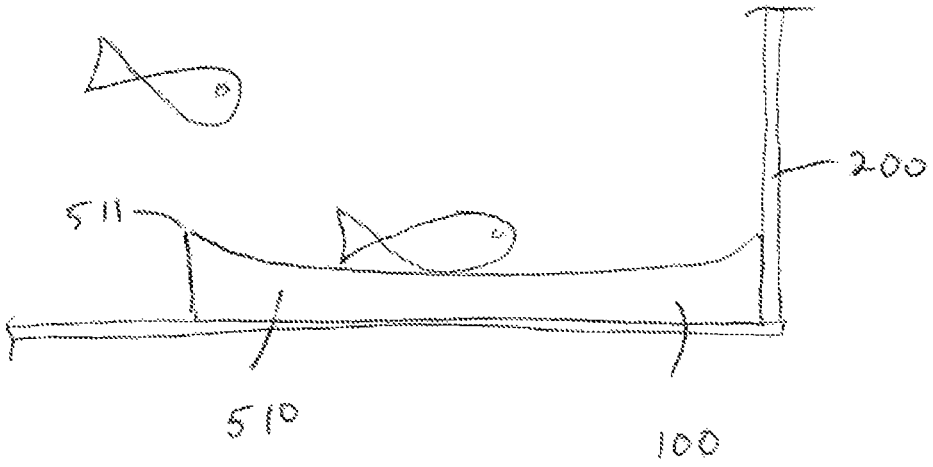
FIG. 13 is a side view of part of a tank and a transmitter including a trough or shallow tray for the toy to settle in for the purposes of charging and to help prevent a charging toy from being moved away from the transmitter by non charging toys.

The toy 300 may rely on a controller sensing a proximity signal in the form of an induced voltage, current and/or power increase across its charging circuit when it is near the charge transmitter 100 (power transfer transmitter). It may use onboard sensor circuitry, such as a microcontroller, microprocesser or other IC, to sense such an increase (or otherwise measure it from the power transfer transmitter and/or charging circuitry). The controller may ignore the increase in voltage, current and/or power across the charging circuit if the battery voltage is above a certain threshold and the toy is not in need of recharging. In this case, the toy 300 continues to be normally propelled. But if the battery voltage is below a certain threshold the controller of the toy may respond appropriately when the charge field is detected for the purposes of being recharged. When the voltage is below a certain threshold, the toy may enter into a charge seeking mode. This may include the toy slowing down to (a) conserve power (b) be at a speed that is better suited to becoming located in the charge field and (c) sink lower and towards the bottom of the tanks (or the top if the toy is positively buoyed). In its charge seeking mode, when the toy detects a sufficient proximity signal, e.g. a sufficient induced voltage, current and/or power level in the charging circuitry due to the toy being in the charge field or zone and sufficiently close to the charge transmitter, it may switch it's propeller off and with any remaining momentum travel/sink onto or in close proximity to the charge transmitter as seen by the arrow and X marking the rest spot in FIGS. 10 and 11. Here it can remain until recharged. Recharging may involve sensing the voltage of the battery and once it reaches a certain level, the controller onboard the toy may control the toy to start its propeller and resume movement in the tank. Alternatively, a second, external controller may receive input from the onboard sensing circuitry and remotely start or slow down the propeller to thereby control movement of the toy 300. If the toy 300 settles in a location too far away from the charge transmitter 100, the controller can sense an insufficient induced voltage, current and/or power level across the charging circuitry and may then activate the propeller to cause the toy to move and make a new attempt at getting sufficiently close to the charge transmitter. Alternatively, the controller may send a signal to the external controller remotely located from the toy 300 and let the external controller to activate the propeller to cause the toy to move and make a new attempt. At timed delay may be built in before the toy's propeller is activated in this way. FIG. 12 shows a failed attempt.

By way of example, peak operating voltage of the toy may be 4.2 v. When the battery voltage drops to 2.2 v, the toy enters into a charge seeking mode. This may involve reducing speed. When the toy senses a voltage differential of 0.2 v across the charge circuitry due to being sufficiently close to the charge transmitter 100, its propeller is turned off, either by its own onboard controller or remotely turned off by the external controller. If it continues to read a voltage differential of 0.2 v or better, it will remain un-propelled whilst the battery voltage or the charge status is increased in the charging field or zone. When the battery voltage reaches peak voltage or a predetermined threshold voltage slightly lower than the peak voltage, the propeller is activated and the toy resumes movement in the tank.

Other ways of sensing such as using a dedicated sensing circuit that may sense power increase or the magnetic or electric field around the charging transmitter may be used. An alternative is that a separate signal (not that created by the charging transmitter) is detectable in the tank to indicate to the toy that its proximate the charging transmitter 100, such as an IR signal.

As mentioned above, a second, external controller may be included in the system. The external controller may be located in close proximity to the charge transmitter 100 and the tank 200, or in any other desired location. The external controller may be arranged to control movement of the toy by for example selectively activating and deactivating the propeller and/or different modes of operation based on input received from the onboard controller and/or the onboard sensing circuitry.

By way of example, when the toy senses that the battery voltage has dropped to a predetermined level such as 2.2V, the toy may send a signal to the external controller to indicate the battery voltage level is low and/or charging is required. The external controller receives such input, and activates the charge seeking mode of the toy 300. When the toy senses a voltage differential of 0.2V across the charge circuitry, it may send another signal to the external controller to indicate that the toy 300 is near the transmitter 100, or it is near or within a charging zone. The external controller may reduce the power supplied to the propeller or turns off the propeller upon receiving the signal from the toy to allow the toy to slowly enter and localise itself within the charging zone. When the battery voltage reaches the peak voltage or a predetermined voltage, the external controller activates the propeller and the toy 300 resumes movement within the tank 200.

The tank 200 may contain multiple toys. In order to help prevent a toy that is being charged from being moved by other toys when such may collide, a trough or shallow dish 510 may be provided at the charge transmitter 100. This may include a perimeter lip 511 that may help retain charging toy(s) in the event that such are hit by other toys in the tank.

The toy 300 may be capable of moving from the body of water onto a raised surface at which its onboard battery can be recharged. The toy 300 may for example be a replica turtle that can move onto a simulated beach of the tank at or adjacent which a charge transmitter may be located.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. Apparatus for providing a kinetic display, the apparatus comprising:

a container defining a movement limiting environment in which a mobile apparatus is to move, and further configured to contain a liquid medium; and a submersible negatively buoyant mobile biominetic aquatic toy comprising an inductively chargeable battery and being capable of self-locomotion in the environment under power derived from the battery via an oscillatory propeller;

wherein the container comprises an inductive charging device having a defined zone in said environment, at or near a bottom of the container, located in operation in the liquid medium, to inductively interact to charge the battery of the mobile apparatus when said mobile apparatus is at least in a position selected from one of (a) sufficient proximity to the zone and (b) stationed at or in the zone; and wherein the toy has control functionality to affect the propeller and able to favor proximity to the charging device to charge the battery, the control functionality responsive to a battery charge status such that it:

i. if fully charged, allows unrestricted movement of the toy in the environment when the battery charge status remains above a first charge status below full charge status, ii. if below said first charge status, limits the drive so the toy sinks in the liquid medium sufficient to at least one of locate to (a) and (b), iii. if (ii) has occurred, allows restricted movement of the toy in the environment only sufficient to localize to the zone even when the charge status is above said first charge status, and iv. if (iii) has occurred, allows unrestricted movement of the toy in the environment when the battery charge status achieves a full charge status or a second charge status below full charge status but above the first charge status.

2. An apparatus as claimed in claim 1 wherein the container comprises a shallow trough defined in said environment to facilitate retention of the toy at or proximate said zone when charging.

3. An apparatus as claimed in claim 1 wherein the oscillatory propeller is driven by a coil and magnet arrangement, the coil when powered causing the propeller to oscillate.

4. An apparatus as claimed in claim 1 wherein the control functionality to affect the driver to favor proximity to the charging device has no input from outside the environment.

5. An apparatus as claimed in claim 1 wherein the toy is negatively buoyed and has a thrust angle aiming slightly up during self-locomotion.

6. An assembly, comprising:

an aquatic and negatively buoyant submersible toy comprising a body carrying a rechargeable battery, a battery powered propeller to self-propel the toy through a body of water, and a contactless power transfer receiver to receive electrical power to charge the battery; and a tank having a base and side walls to retain a body of water for said toy to be submersed in, the tank comprising a contactless or wireless electrical power transfer transmitter located at or towards the base, wherein the toy when in sufficient proximity to the transmitter receives power from the transmitter;

the toy further comprising an on-board controller to stop or reduce drive to the propeller, to allow the toy to sink, so the toy locates itself at or near the transmitter to allow a recharge of the battery, when the on-board controller determines a battery status condition situation is met.

7. The assembly as claimed in claim 6 wherein the powered propeller is one or more selected from a fin, screw propeller, foil and impeller.

8. The assembly as claimed in claim 6 wherein the toy is arranged and configured so that when the propeller is powered, the toy moves through the body of water but when not powered, the toy sinks in the body of water.

9. The assembly as claimed in claim 6 wherein the propeller is driven by an electrically powered driver and the toy sinks in the body of water when the battery power supplied to the driver falls below a certain limit or is terminated.

10. The assembly as claimed in claim 6 wherein the toy comprises a controller to stop the propeller to allow the toy to settle and allow a recharge of the battery in a situation selected from one of:

when the battery runs out of electrical power, and when the battery drops below a certain voltage level, and after a certain time interval.

11. The assembly as claimed in claim 6 wherein the toy includes a controller to terminate propulsion until a certain battery voltage is exceeded before starting propulsion.

12. A submersible toy as claimed in claim 6 wherein the controller terminates power delivered to the propeller when recharging of said battery is detected, when said battery voltage is below a predetermined level that is below its peak charge.

13. A submersible toy as claimed in claim 6 wherein the controller reduces the power delivered to the propeller when the battery voltage drops below a certain limit, and terminates power delivered to the propeller when recharging of said battery is detected.

14. A submersible toy as claimed in claim 6 wherein the controller terminates power to the propeller when the battery voltage drops below a predetermined low voltage level or after a certain interval and recommences provision of power to the propeller when the battery voltage exceeds a recharge voltage.

15. A submersible toy as claimed in claim 6 wherein the toy comprises an external controller which receives input from the onboard controller of the toy, said external controller is arranged to activate a charge seeking model of the toy and to control movement of the toy by controlling the power supplied to the propeller.

16. A method of recharging a self-propelled submersible toy contained in a movement limiting environment defined by a tank configured to retain water, said toy comprises an onboard wirelessly rechargeable battery, said tank comprises a wireless power transfer transmitter arranged to recharge the onboard battery of the toy, the method comprising the steps of:

determining, with the controller, the charge status of the toy;

controlling, with the controller, movement of the toy to encourage the toy to submersibly settle at a desired recharging zone; and wirelessly charging the battery in the recharging zone with the wireless power transfer transmitter.

17. A method of recharging a self-propelled toy as claimed in claim 16 wherein before detecting proximity of the toy to the transmitter, detecting battery voltage and activating a charge seeking mode when the voltage detected falls below a predetermined threshold voltage.

18. A method of recharging a self-propelled toy as claimed in claim 16 further comprising starting propulsion of the toy again after a predetermined time period or after the battery voltage increases to a predetermined voltage level.

19. A method of recharging a self-propelled toy as claimed in claim 16 further comprising the tank detecting proximity of the toy to the power transfer transmitter and generating a representative proximity signal.

20. A method of recharging a self-propelled toy as claimed in claim 19 further comprising, the controller controlling movement of the toy based on the proximity signal to encourage the toy to submersibly settle in a desired recharging zone.

21. A method of recharging a self-propelled toy as claimed in claim 16 further comprising determining a desired recharging zone generated by the transmitter.

* * * * *